US006352352B1

(12) United States Patent
Schletterer et al.

(10) Patent No.: US 6,352,352 B1
(45) Date of Patent: Mar. 5, 2002

(54) LUMINESCENT CONTAINER WITH QUICK-CHARGING POWER SOURCE

(76) Inventors: Georg Schletterer, Beda-Weber-Gasse 7, A-6020 Innsbruck; Opadia Hauser, Mitterpettneu 219, Pettneu; Michael Lerchster, Riedgasse 15, Innsbruck, all of (AT)

( * ) Notice: Subject to any disclaimer, the term of this patent is extended or adjusted under 35 U.S.C. 154(b) by 0 days.

(21) Appl. No.: 09/384,917

(22) Filed: Aug. 27, 1999

(51) Int. Cl.[7] ..... F21L 13/00

(52) U.S. Cl. ..... 362/183; 446/438; 320/167; 362/154; 362/101

(58) Field of Search ..... 362/101, 154, 362/84, 125, 362, 183; 446/219; 307/109, 66, 157; 320/166

(56) References Cited

U.S. PATENT DOCUMENTS 2,224,319 A * 12/1940 Schroyer ..... 362/101
4,496,939 A * 1/1985 Moberg ..... 340/636
5,070,435 A * 12/1991 Weller ..... 362/101
5,211,699 A * 5/1993 Tipton ..... 362/101
5,251,118 A * 10/1993 Budnovitch ..... 362/362
5,461,297 A * 10/1995 Crawford ..... 320/166
5,743,620 A * 4/1998 Rojas ..... 362/101
5,782,552 A * 7/1998 Green ..... 362/183
5,879,068 A * 3/1999 Menashrov ..... 362/101
5,931,558 A * 8/1999 Chen ..... 362/101
5,932,992 A * 8/1999 Tomatsu ..... 320/167
6,171,171 B1 * 1/2001 Barthold ..... 446/438

* cited by examiner

*Primary Examiner*—Alan Cariaso
*Assistant Examiner*—Hargobind S. Sawhney
(74) *Attorney, Agent, or Firm*—Herbert L. Lerner; Laurence A. Greenberg; Werner H. Stemer

(57) ABSTRACT

A drink container, such as a drinking glass, drinking cup, a vase, or a bottle, is illuminated with an LED. The power for the LED is supplied by quick-charging capacitors which are integrated in a cavity of the container together with the LED. The LED is disposed in a wedge-shaped recess which effects advantageous distribution of the light through the obliquely inclined walls. The capacitors are typically charged within a matter of seconds and they have a virtually unlimited cycle life.

10 Claims, 1 Drawing Sheet

LUMINESCENT CONTAINER WITH QUICK-CHARGING POWER SOURCE

BACKGROUND OF THE INVENTION

1. Field of the Invention

The invention relates to a luminescent devices with a rechargeable power source. More specifically, the invention pertains to containers such as drinking glasses, cups, bottles, and the like, with an integrated luminescent source.

2. Description of the Related Art

Containers of this general type have been known in the art. Typically, a light source is integrated in a translucent container and the light source is fed from a battery or rechargeable accumulator disposed in a power source compartment formed in the body of the container.

U.S. Pat. No. 5,575,553 to Tipton, for example, describes a drink container with a hollow base cavity. One or more LEDs are integrated into the side walls of the container below the container bottom. A battery is supplies the power for illuminating the LEDs and a switch allows selective on/off cycles of the devices.

Alternatively, chemiluminescent materials may be integrated in the container to provide for the desired illumination. For example, U.S. Pat. No. 5,609,409 to Diehl describes a drinking glass of translucent or transparent material with a hollow stem. The cavity in the stem receives a chemiluminescent stick which illuminates the stem.

The prior art devices are subject to several disadvantages. For instance, the battery operated devices must be formed with an access opening through which the battery or batteries must be exchanged after they have been used. The rechargeable devices are also subject to a relatively limited number of charge cycles before the accumulator must be exchanged or the entire container must be discarded. Furthermore, the accumulator is subject to extended charging periods.

SUMMARY OF THE INVENTION

It is accordingly an object of the invention to provide a luminescent container with a rechargeable power source, which overcomes the above-mentioned disadvantages of the heretofore-known devices and methods of this general type and which allows for quick recharging, has a virtually unlimited number of recharge cycles, and has a completely sealed power chamber.

With the foregoing and other objects in view there is provided, in accordance with the invention, a luminescent device, comprising:

- a body at least partly made of translucent material and having a cavity formed therein;
- an electrical light source disposed in the cavity; and
- a capacitor connected to the light source for supplying power to the light source.

By using one or more capacitors as the emf source, the device provides for various advantages. For example, no batteries or charge accumulators need be provided with their attendant shortcomings, which includes the notoriously limited cycle life and the concomitant environmental hazards. It is no longer necessary to charge the device for extended periods of time. Instead, a typical charge cycle may be typically completed within a few seconds. Furthermore, it is possible to completely seal the cavity.

In accordance with an added feature of the invention, there are provided electrical terminals connected to the capacitor for charging the capacitor from outside the cavity. The cavity is water-tightly and air-tightly sealed so that the device is useable as a drink container which is machine-washable, for example.

In accordance with an additional feature of the invention, the cavity is a wedge-shaped recess formed in the body. The wedge-shaped recess provides for walls that deflect the light of the light source and scatter the illumination into the container. The walls of the recess may be suitably ribbed (e.g. Fresnel lens) to essentially further focus the light into the body of the container.

In accordance with another feature of the invention, the capacitor is one of a plurality of capacitors mutually connected in parallel.

In accordance with a further feature of the invention, a DC/DC converter circuit is connected between the capacitor and the light source.

In accordance with again another feature of the invention, the body is a drinking glass and the cavity is formed in a false bottom of the drinking glass.

In accordance with a concomitant feature of the invention, the light source is an LED.

The invention is particularly useful in commercial drinking establishments. For instance, the drink container may carry an advertising message which will be illuminated for a given length of time (depending on the capacitance, the charge depth of the capacitors, and the power consumption of the LED and the driver circuit), or the container may simply be used as a fancy drink glass. Especially in bars, nightclubs, and other dimly lit establishments it is helpful for the service staff to be able to see the amount of drink left in a patron's glass. Also, if the cycle time is adjusted to, say, one half hour, that time period would coincide with the typical drink cycle time. When the glass is no longer illuminated, the server will recognize that the patron should likely be served another drink.

Other features which are considered as characteristic for the invention are set forth in the appended claims.

Although the invention is illustrated and described herein as embodied in a luminescent container with a rechargeable power source, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawing.

DESCRIPTION OF THE PREFERRED EMBODIMENTS

Figure 1:
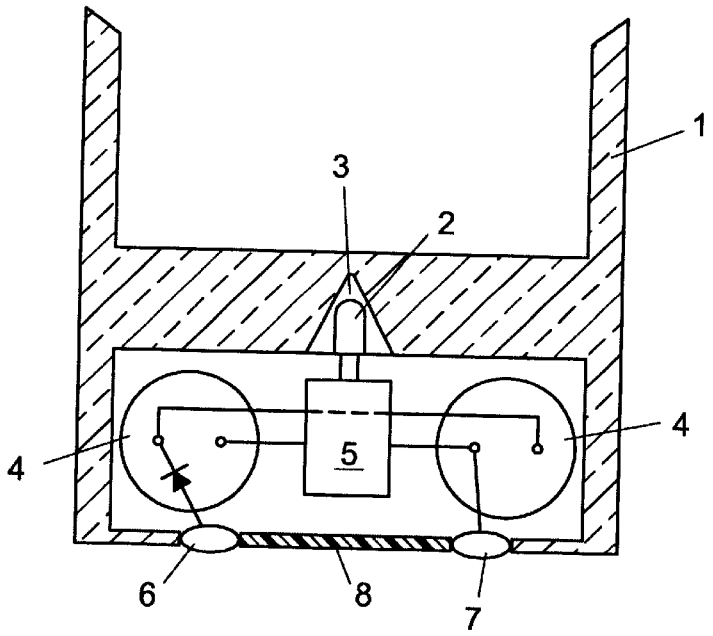
FIG. 1 is a diagrammatic sectional view of an exemplary drinking container with the integrated light source according to the invention.

Referring now to the figures of the drawing in detail and first, particularly, to FIG. 1 thereof, there is seen a container 1 formed of translucent or transparent material. The material may be glass or any of various types of plastic that are useable drink or food containers. The exemplary embodiment of FIG. 1 illustrates a plastic drinking cup.

The bottom wall of the container 1 has a light source 2 integrated in a cavity 3. The cavity 3 of the preferred embodiment is triangular in section, i.e., it is a wedge-shaped indentation in the material of the container 1. The inclined walls of the wedge-shaped cavity effect an advantageous distribution and diffraction of the light emitted by the light source 2 into and throughout the material of the container 1. The light source 2 of the preferred embodiment is a superbright LED.

The necessary power for lighting the LED is provided by two capacitors 4 which are connected to the LED through a circuit 5. The capacitors 4 can be recharged via two electrical terminals formed by charge pads 6 and 7 which are exposed at the bottom of the container 1. In order to assure their corrosion resistance, the pads 6 and 7 may be gilded terminal pads. The cavity in the bottom of the container 1 is closed off by a lid 8. The lid 8 is a sealing layer formed of a quick-hardening two-component epoxy glue system. In the alternative, the lid 8 and the opening in the bottom of the container 1 may be provided with corresponding lips and the lid 8 may be sealed to the container by ultrasound welding. The important aspect to be taken into consideration is the watertight sealing of the cavity which satisfies the respectively pertinent standards. In the context of the drink or food containers, for instance, it is important to satisfy the necessary health standard requirements in the sealing process.

Figure 2:
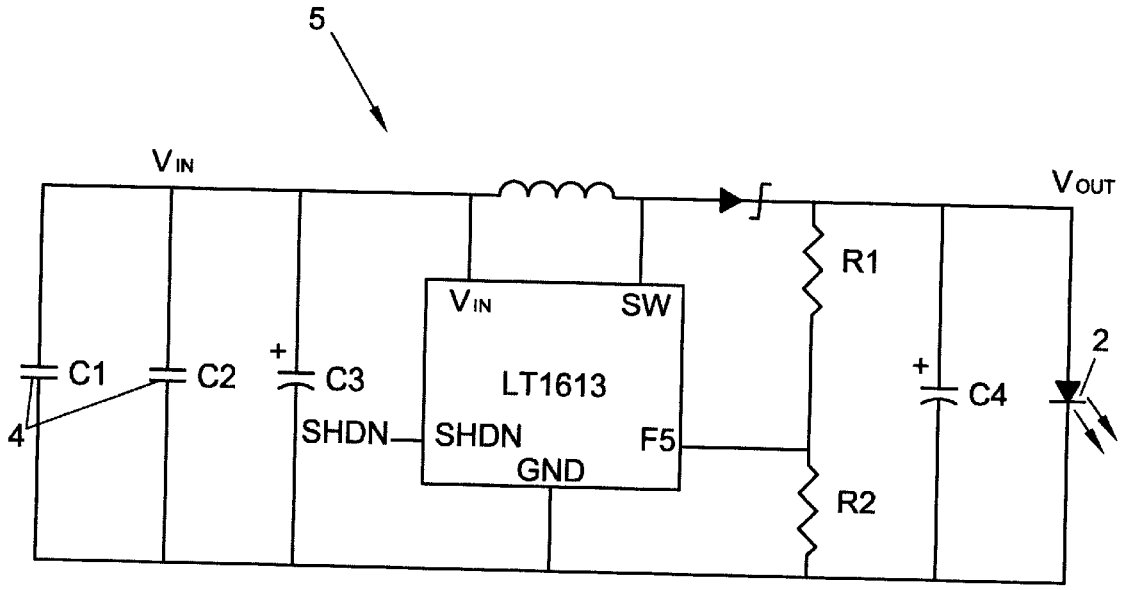
FIG. 2 is a circuit schematic of the power and light source used in the embodiment of FIG. 1.

Referring now to FIG. 2, there is seen a schematic of an exemplary power circuit for the illumination of the container 1. The heart of the circuit is formed by a DC/DC converter 10 connected between the capacitors 4 and the light source 2. The DC/DC converter 10 of the preferred embodiment is a driver chip LT1613 of Linear Technology Inc., California. The LT1613 is described as a fixed frequency 1.4 MHz, single cell DC/DC converter. The input voltage VIN of the LT1613 is rated from 1 V to 10 V. The chip provides a convenient shutdown pin SHDN which is connected, in the exemplary embodiment, to disconnect the power feed to the LED during the charge cycle of the capacitors 4. Alternatively, the shutdown pin may also be connected to an external switch (e.g. a pushbutton toggle switch) with which the light source 2 may be turned on or off.

The capacitors 4 are connected in parallel (C1+C2=C) and form the source of emf for the circuit. The capacitors 4 of the preferred embodiment are Panasonic® Gold Cap 2.3 V and 22F. The capacitors 4 are suitably connected to the charge pads 6 and 7. The charging operation, depending on the charge circuit, typically lasts only a few seconds and the capacitors illuminate the LED 2 for approximately one half hour. For protective purposes, the connection between the pads 6, 7 and the capacitors is provided with a diode connected in the forward direction so as to allow charging of the capacitors but to avoid discharging through the pads 6, 7.

What is claimed is:

1. A luminescent device, comprising:

a body at least partly made of translucent material and having a cavity formed therein;

an electrical light source disposed in said cavity; and a capacitor permanently disposed and water-tightly seal in said body, said capacitor chrged with a charging source outside said body, said capacitor connected to said light source for supplying power to said light source.

2. The luminescent device according to claim 1, which further comprises electrical terminals connected to said capacitor for charging said capacitor from outside said cavity.

3. The luminescent device according to claim 1, wherein said cavity is a wedge-shaped recess formed in said body.

4. The luminescent device according to claim 1, wherein said capacitor is one of a plurality of capacitors mutually connected in parallel.

5. The luminescent device according to claim 1, which further comprises a DC/DC converter circuit connected between said capacitor and said light source.

6. The luminescent device according to claim 1, wherein said body is a drinking glass and said cavity is formed in a false bottom of said drinking glass.

7. The luminescent device according to claim 1, wherein said light source is an LED.

8. A luminescent device, comprising:

a body at least partly made of translucent material and having a cavity formed therein;

an electrical light source disposed in said cavity;

an energy source connected to said electrical light source for supplying electrical energy to said electrical light source, said energy source including a capacitor permanently disposed and water-tightly sealed in said body and connected to supply said electrical light source with the electrical energy necessary for powering said light source; and electrical terminals connected to said capacitor and disposed to enable intermittent charging of said capacitor from outside said cavity.

9. The luminescent device according to claim 8, wherein said capacitor is one of a plurality of mutually interconnected capacitors.

10. The luminescent device according to claim 8, wherein said body is a drinking glass and said cavity is formed in a false bottom of said drinking glass.

* * * * *